United States Patent [19]

Byrne

[11] 4,216,706

[45] Aug. 12, 1980

[54] MANUFACTURE OF SMOKING ARTICLES

[75] Inventor: Stanley W. Byrne, No. Crawley, England

[73] Assignee: American Filtrona Corporation, Richmond, Va.

[21] Appl. No.: 935,900

[22] Filed: Aug. 23, 1978

[30] Foreign Application Priority Data

Sep. 5, 1977 [GB] United Kingdom ..... 37002/77

[51] Int. Cl.[2] ..... A24C 5/50

[52] U.S. Cl. ..... 93/77 FT

[58] Field of Search ..... 93/77 FT, 1 C; 209/535, 209/615, 616; 198/461, 692, 693; 221/213

[56] References Cited

U.S. PATENT DOCUMENTS 4,063,494 12/1977 Hall ..... 93/77 FT

FOREIGN PATENT DOCUMENTS 687301 5/1964 Canada .
699358 12/1964 Canada .
880094 9/1971 Canada .
1932607 12/1971 Fed. Rep. of Germany ..... 93/77 FT
1339239 11/1973 United Kingdom ..... 93/77 FT

*Primary Examiner*—R. L. Spruill
*Assistant Examiner*—K. Y. Lin
*Attorney, Agent, or Firm*—Holman & Stern

[57] ABSTRACT

A process and apparatus for producing filter cigarette tubes is disclosed. A string of filter plugs is advanced continuously in longitudinal abutting relationship to a separating and accelerating device comprising a rapidly rotating wheel having a pair of pins projecting from the circumference. The pins pierce a leading plug of the string and accelerate it away from the following plugs. This is repeated with successive plugs on successive rotations of the wheel. The spaced plugs are fed continuously onto an advancing tape of cigarette paper, the tape and spaced plugs are wrapped into a tube and the tube is cut continuously into cigarette lengths each having a plug at the end.

8 Claims, 4 Drawing Figures

MANUFACTURE OF SMOKING ARTICLES

BACKGROUND OF THE INVENTION

This invention relates to the manufacture of tubes for filter cigarettes - that is, empty tubes of cigarette paper closed at one end by a plug of tobacco smoke filtering material. The tubes are intended to be retailed in this empty condition, to be filled with tobacco by the customer; hand operated machines for the latter purpose are commercially available.

In the method and apparatus according to the invention individual plugs are continuously supplied, longitudinally spaced apart, onto a continuously advancing band or tape of cigarette paper which carries the plugs continuously through a wrapping garniture in which the paper is wrapped around the plugs to yield continuously a tube of the cigarette paper (usually with a lapped and stuck longitudinal seam) having the plugs spaced therealong at the required intervals. The continuously produced tube is cut transversely as it is formed into individual lengths each closed by a filter plug at one end and opens at the other for the subsesquent receipt of tobacco. The length ratio of empty tube to filter plug in the product tubes might for examples be 3 or 4 to 1, or higher.

The production of tubes having such a high length ratio can in practice pose registration difficulties. Unless the individual plugs are initially spaced accurately and uniformly along the cigarette paper the final cutting step can lead to an unacceptable proportion of useless product tubes—e.g., tubes having plugs of the wrong length or plug portions at each or neither end. Usually the initially supplied filter plugs are double length plugs and are spaced apart by double the length of the empty tube portion in the individual product tubes; the continuously produced tube is then cut midway along each plug and midway between them.

SUMMARY OF THE INVENTION

In the preferred method of the present invention, a string of the plugs in end to end abutment is continuously advanced longitudinally to a separator station where the individual plugs are accelerated longitudinally as they arrive successively at the station so that they become longitudinally spaced along their travel path, the spaced plugs then being supplied on to the continuously advancing band or tape of cigarette paper. An advantage of this procedure is that is allows the whole production of the finished article - from the initial supply of the filtering material for the plugs, its formation into the plugs, and their spacing and wrapping to form the filtered cigarette tube product—to be effected in a continuous in-line operation. Thus a continuous rod of the required smoke filtering material can be formed continuously, and cut transversely to form a string to end-to-end abutting plugs, by any conventional in-line procedure (as described, for example, in British Patent Nos. 1,221,346 and 1,169,932), the in-line procedure being uninterrupted as the plugs of the string continue longitudinally through the longitudinal spacing and enwrapping stages and the final step in which the continuously formed product is severed to give the final filtered tubes. High acceleration is necessary to give the required plug spacing (e.g., a spacing of two or three or more plug lengths between each plug) and, at the throughout speeds necessary for viable commercial operation, it is difficult to achieve this degree of acceleration while retaining sufficiently accurate and uniform spacing to avoid the registration problems previously mentioned. In order to obtain the necessary accuracy at high throughput it has been found best to employ a separator in which each plug of the string as it is fed to the separator is pierced laterally by one or more pins or needles which are moved rapidly along the travel path to space the plug positively and accurately from the succeeding plug, the pin(s) or needle(s) being withdrawn from the plug when it is positively engaged by and traveling with the tape or band of cigarette paper. The pin(s) or needle(s) can for example be provided on the periphery of a rapidly rotating wheel disposed above the travel path with its axis perpendicular to the travel path, the rotation of the wheel being so geared to the rate of feed of the string of plugs and the pins or needles being so positioned that each plug as it moves below the wheel is pierced and immediately accelerated away from the succeeding plug, and is deposited onto the tape or band of cigarette paper with withdrawal of the pin(s) or needle(s) on continued rotation of the wheel; the plugs thus progress smoothly and continuously to and through the separation stage for spaced disposition on the cigarette paper.

The spaced plugs are preferably deposited on the longitudinally advancing band or tape of cigarette paper adjacent to a guard member which prevents deviation of the plugs from their longitidinal path on the withdrawal of the pin(s) or needle(s) therefrom. The tendency of a plug to move laterally with a pin or needle as the latter is withdrawn laterally might otherwise interfere with the accuracy of the spacing of the plugs on the cigarette paper.

The positive advancing of the plugs by means of the lateral pins or needles permits uniform and accurate high acceleration of successive plugs to give the required wide and uniform spacing of the plugs along the cigarette paper.

In a current embodiment the plugs are accelerated by a wheel having a single pin or group of pins for engaging with one plug, so that the wheel rotates through a complete revolution between engagement with one plug and the next. In other embodiments, however, individual pins or group of pins may be equispaced around the wheel periphery. A wheel with projecting pins is preferred for accuracy and reliablity, but the pin or pins could, for example, be provided instead on the surface of an endless belt having part of its run extending along the plug travel path.

The surface of the longitudinally advancing band or tape of cigarette paper on which the accurately spaced plugs are deposited may have a continuous or discontinuous adhesive coating, or be otherwise rendered tacky, to facilitate positive plug/paper engagement and avoid slippage which would lead to registration problems in the final step of cutting the tubes.

The advancing cigarette paper band or tape with the accurately and uniformly spaced plugs thereon may then pass continuously through a conventional garniture for continuous formation of a tube with a lapped and stuck seam, and the resulting tube then be cut transversely as described to form the product filtered tubes. The band or tape will usually be conveyed to and through the garniture and up to the cutter on an endless belt conveyor.

The cigarette paper used may be pre-printed; it may, for example, be pre-printed at the regions to surround the filter plugs with a simulated cork-tip pattern, and a motif or name or other indicia may also be pre-printed adjacent to these regions. With pre-printing care must be taken to achieve and maintain registration between printed areas and deposited plugs.

BRIEF DESCRIPTION OF THE DRAWING

An embodiment of the invention will now be described, by way of example only, with reference to the accompanying drawings.

DESCRIPTION OF PREFERRED EMBODIMENT

Figure 1:
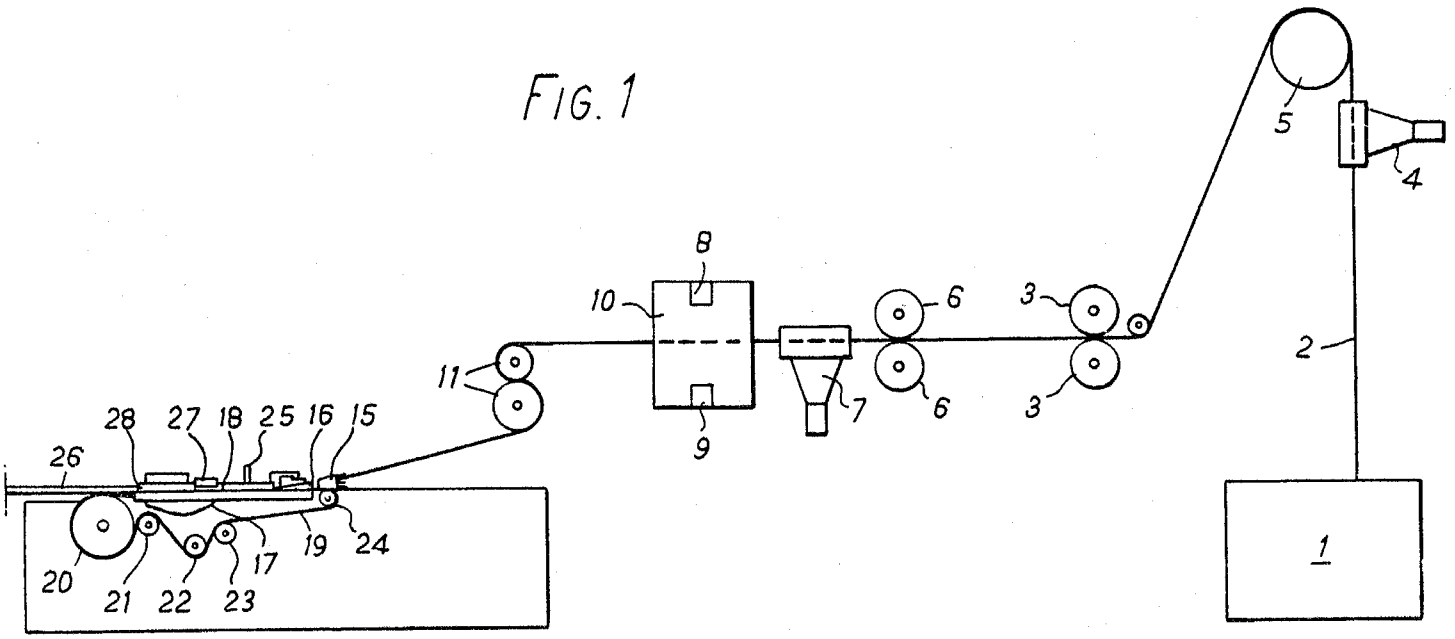
FIGS. 1 and 2 are schematic elevation views showing diagrammatically between them a complete apparatus (FIG. 1 the right-hand end, FIG. 2 the left-hand end) and method according to the invention for the continuous in-line production of filtered cigarette tubes.

Referring to FIGS. 1 to 4, these illustrate a continuous in-line method and apparatus in which a rod of bonded cellulose acetate filaments is formed continuously in known manner and cut into abutting plugs, these then being spaced apart and formed into filtered cigarette tubes. In this embodiment cellulose acetate tow 2 (FIG. 1) is drawn from a bale 1 through an air banding jet 4 over a cylindrical guide 5 by rollers 3. Rollers 6, which rotate faster than rollers 3, stretch the tow between themselves and rollers 3. A further air banding jet 7 forms the two into a band approximately 250 mm. wide before it passes into a box 10 where it is sprayed with glyceryl triacetate by spray guns 8 and 9. The banding jets 4 and 7 are of known form and comprise a narrow slot through which the tow passes. On one side of the slot is a perforate wall communicating with a supply of compressed air and on the other side of the slot an imperforate wall retains the tow while the air impinges upon it. Rollers 11 hold the tow in the band form until it passes through funnel 15 which converts it from a band form into a cylindrical form before it enters beneath a tongue 16. The tongue serves to guide the tow into a heating enclosure 18 as well as correctly to position a pervious tape 19 around the tow. The pervious tape which is drawn through the heating enclosure by drum 20 and which is further trained around rollers 21, 22, 23 and 24 has an open structure and may be made from woven nylon or polyethylene terephthalate monofilament. The tape may have a surface coating to prevent the tow 2 from adhering to it. The heating enclosure 18 is provided with a conduit 25 connected to a supply of steam which passes through passageways in the enclosure, then through the tape and into the tow in order to heat it and cause the glyceryl triacetate to bond the filaments of cellulose acetate to each other.

Thus by the bonding of the filaments, rod 26 is formed. The longitudinal edges of the tape 19 do not generally meet each other perfectly so that some of the filaments of the two press between the edges forming a ridge. This ridge is removed by a presser foot 27 which lies between the edges of the tape and serves to press upon the ridge thus reforming the rod into a substantially cylindrical shape. Then the rod passes into a cooling enclosure 28 wherein air or other gas supplied through a conduit passes through the tape and into contact with the filaments of the rod in order to cool them and to remove any condensate from the rod 26. Preferably, the cooling air passes through the tape at a multiplicity of points spaced along the length of the cooling enclosure 28. After passing through the rod, the air with any entrained condensate passes into receiver 17, which is vented towards the rear of the machine. The result of the action of the air is also to cause the rod to become more rigid.

Figure 2:
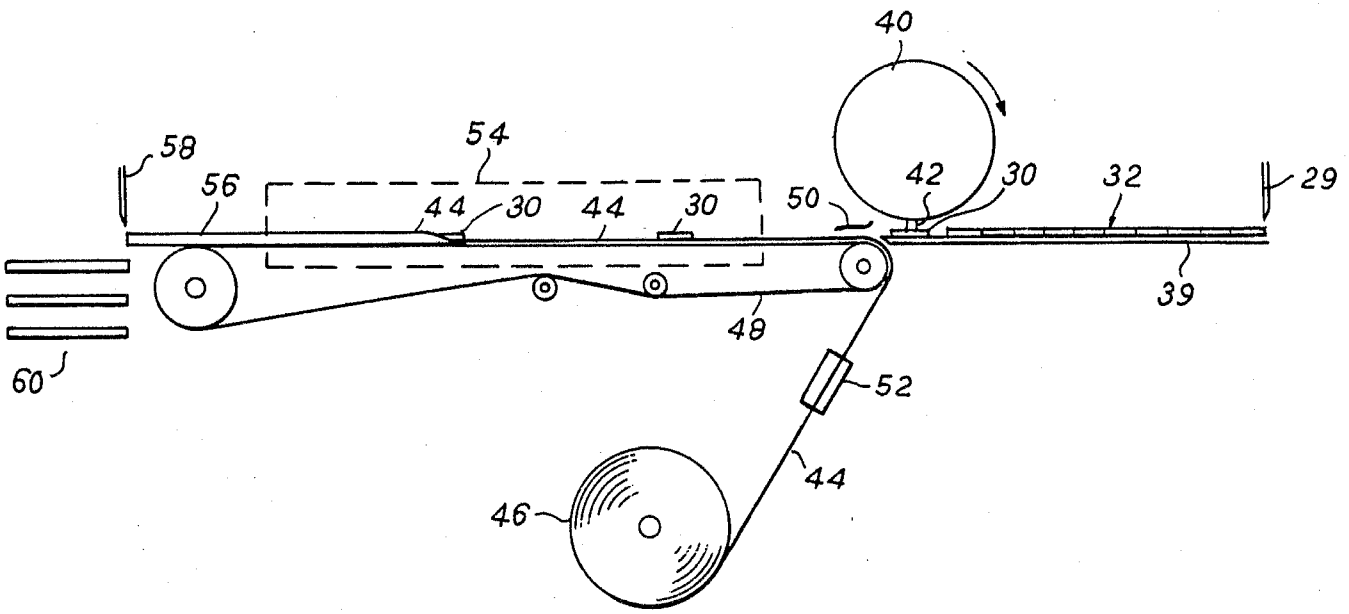
Figure 3:
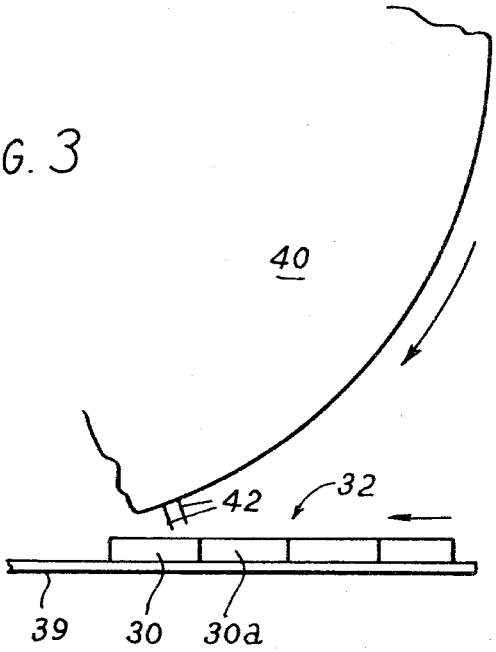
FIGS. 3 and 4 illustrate more clearly the plug spacing procedure and device of FIG. 2.
Figure 4:
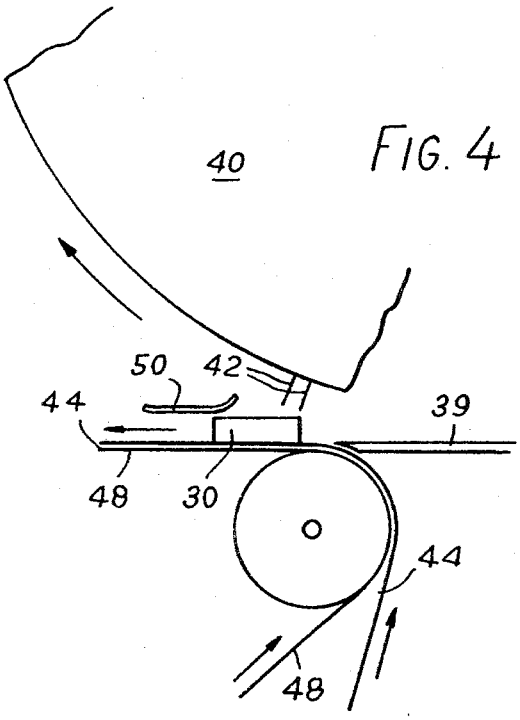

The resulting rod issuing continuously from the cooling enclosure 28 passes directly to a rotary cutter 29 (FIG. 2). For some purposes it may be preferred to wrap the rod before it is cut, a conventional wrapping garniture being disposed between enclosure 28 and cutter 29. Where a wrapped cellulose acetate filament rod is to be used, however, it may be preferred instead to omit steaming and cooling, the plasticized tow simply being gathered and wrapped in one operation by passage through a single rod-forming and wrapping garniture. The cutter has a plurality of blades, preferably two, which rotate at high speed, geared to the speed of travel of the two through the rod-forming machine, to intercept the path of the rod and cut it into plugs 30 (FIG. 2) of the required length. The cutter 29 is oscillated bodily longitudinally of the rod so that adjacent cut plugs remain in abutment and continue to be pushed forward longitudinally by the continuously issuing uncut rod portion. The resulting string 32 of cut plugs is fed directly along a tube 39 under a vertical accelerator wheel 40 which rotates in the direction of the arrow about a horizontal axis perpendicular to the travel path of the plugs 30. Wheel 40 has a pair of closely spaced radial pins 42 projecting from its cylindrical periphery, and the apparatus is set up so that as the leading plug 30 of string 32 comes under wheel 40 (FIG. 3) the pins 42 are moving toward the bottom of their travel path and so pierce plug 30 laterally. Wheel 40 rotates at such a speed that the velocity of pins 42 along the plug travel path, as they traverse the bottom portion of their run from where they first engage a plug (FIG. 3), is greater than the longitudinal feed velocity of string 32 to the wheel 40. The leading plug 30 pierced and engaged by pins 42 is thus accelerated and spaced longitudinally away from the succeeding plug 30*a* until, with continued rotation of wheel 40 to the FIG. 4 position, the pins 42 withdraw from the plug. It is at this position that the pins 42 deliver the plug 30 onto a tape 44 of cigarette paper supplied from a reel 46 and advanced longitudinally on an endless belt conveyor 48. A guard tongue 50 prevents any tendency of plug 30 to lift away from tape 44 as the pins 42 are withdrawn with rotation of wheel 40. The longitudinal velocity of tape 44 is maintained equal to that of the plugs 30 supplied thereto, and risk of slippage between plug and tape can be reduced by applying a continuous or discontinuous adhesive coating by means of applicator 52 to the face to receive the plugs. The rotation of wheel 40 and the speed of supply of string 32 are geared together so that when wheel 40 has rotated from the FIG. 4 back to the FIG. 3 position the succeeding plug 30*a* has advanced to the position shown for plug 30 in FIG. 3. With the velocities of string 32, wheel 40 and tape 44 maintained in fixed relation, the plugs 30 are thus accurately and positively spaced apart on tape 44 which is then carried on conveyor 48 through a conventional wrapping garniture 54 in which the tape is wrapped to the form of a tube 56 with a lapped and stuck longitudinal seam. The continuously produced tube 56 is cut transversely by cutter 58 at and between plugs into individual filtered cigarette tubes 60 each having one end open and the other closed by a plug portion. The drawings are not to scale. A tube product might, for example, be about 100 mm long, with a filter plug at one end about 20 mm long. To this end the plugs 30 would be 40 mm long and would be spaced apart on tape 44 with 160 mm therebetween.

What is claimed is:

1. A process for the production of filter cigarette tubes comprising continuously advancing a string of tobacco smoke filter plugs having lengths greater than their cross-sectional diameters in end-to-end abutment longitudinally along a travel path that includes a separator station, said separator station including at least one piercing means and means to move said piercing means, piercing each plug of the string by one of said at least one piercing means, moving said at least one piercing means rapidly thereby accelerating the individual plugs longitudinally as they arrive successively at the station to space the plugs longitudinally a distance substantially greater than their lengths along said travel path, providing a continuous advancing tape of cigarette paper to receive the previously spaced plugs, supplying the previously spaced plugs continuously onto said advancing tape to allow nonslip contact with said cigarette paper, continuously enwrapping the cigarette paper around the previously spaced plugs, and severing the resulting continuously produced tube into individual unfilled tubes of finite length.

2. A process according to claim 1 in which each plug of the string, as it is fed to the separator station, is pierced laterally by at least one pin or needle which is moved rapidly along the travel path to space the plug positively from the succeeding plug, said at least one pin or needle being withdrawn from the plug when the plug is positively engaged by and traveling with the tape of cigarette paper.

3. A process according to claim 2 wherein said at least one pin or needle is provided on the periphery of a rapidly rotating wheel disposed above the travel path with its axis perpendicular to the travel path, the rotation of the wheel being geared to the rate of feed of the string of plugs and said at least one pin or needle being positioned to pierce each plug as it moves below the wheel and immediately accelerate the plug from the succeeding plug, the pierced plug being deposited onto the tape of cigarette paper with withdrawal of said at least one pin or needle on continued rotation of the wheel.

4. A process according to claim 2 or 3, wherein the previously spaced plugs are deposited on the longitudinally advancing tape of cigarette paper adjacent to a guard member which prevents deviation of the plugs from their longitudinal path on withdrawl of said at least one pin or needle therefrom.

5. A process according to claim 1, wherein the surface of the longitudinally advancing tape of cigarette paper has a continuous or discontinuous adhesive region to facilitate positive plug/paper engagement.

6. Apparatus for producing tubes for filter cigarettes, the apparatus comprising means for continuously advancing a string of end-to-end abutting tobacco smoke filter plugs having lengths greater than their cross-sectional diameters, longitudinally along a travel path; a separator including a piercing means and means for moving said piercing means on the travel path operable to accelerate longitudinally individual plugs as they arrive successively thereat to space them longitudinally a distance substantially greater than their lengths along the travel path; means for continuously advancing a tape of cigarette paper to receive said previously spaced plugs in non-slip contact thereon; a wrapping garniture for receiving the previously spaced advancing plugs and paper and forming same continuously into a wrapped tube of spaced plugs; and a cutter for severing the resulting continuously produced tube into individual tubes of finite length.

7. Apparatus according to claim 6, wherein the separator has at least one pin or needle and means for moving the pin or needle around an endless path over part of which path said pin or needle engages an advancing plug, accelerates the plug longitudinally while engaged therewith and then withdrawn therefrom.

8. Apparatus according to claim 7, wherein the separator includes a driven wheel and said at least one pin or needle projects from the periphery of said wheel.

* * * * *